US009434507B2

(12) United States Patent
Blay Orenga et al.

(10) Patent No.: US 9,434,507 B2
(45) Date of Patent: Sep. 6, 2016

(54) STACKABLE CONTAINER

(71) Applicant: OBEIKAN MDF ESPANA, S.L., Canet d'en Berenguer (ES)

(72) Inventors: Manuel Blay Orenga, Canet d'en Berenguer (ES); Javier Ramon Garcia Aranda, Canet d'en Berenguer (ES); Salvador Martinez Colorado, Canet d'en Berenguer (ES); Roberto Martinez Palomino, Canet d'en Berenguer (ES); Gabor Vaas, Canet d'en Berenguer (ES); Saad Saleh Al-Azwari, Canet d'en Berenguer (ES); Vicente Bayona Perez, Canet d'en Berenguer (ES)

(73) Assignee: OBEIKAN MDF ESPANA, S.L., Canet D'En Berenguer (Valencia) (ES)

( * ) Notice: Subject to any disclaimer, the term of this patent is extended or adjusted under 35 U.S.C. 154(b) by 49 days.

(21) Appl. No.: 13/671,663

(22) Filed: Nov. 8, 2012

(65) Prior Publication Data

US 2013/0062241 A1 Mar. 14, 2013

Related U.S. Application Data

(63) Continuation of application No. PCT/ES2010/070801, filed on Dec. 3, 2010.

(30) Foreign Application Priority Data

May 11, 2010 (ES) ..... 201030448 U
Jun. 28, 2010 (ES) ..... 201030670 U
Jul. 21, 2010 (ES) ..... 201030758 U

(51) Int. Cl.
*B65D 21/02* (2006.01)
*B65D 6/16* (2006.01)
(Continued)

(52) U.S. Cl.
CPC ..... *B65D 21/0215* (2013.01); *B65D 9/12* (2013.01); *B65D 11/1873* (2013.01); *B65D 13/04* (2013.01); *B65D 21/0212* (2013.01); *B65D 21/0224* (2013.01)

(58) Field of Classification Search
CPC ..... B65D 5/247; B65D 5/26; B65D 5/30; B65D 5/301; B65D 5/302; B65D 5/427; B65D 11/18; B65D 11/1866; B65D 21/0223
USPC ..... 206/509, 517, 577, 600; 220/4.28
See application file for complete search history.

(56) References Cited

U.S. PATENT DOCUMENTS 4,165,003 A * 8/1979 Drader ..... 206/506
4,304,353 A * 12/1981 Stollberg ..... 229/126
(Continued)

FOREIGN PATENT DOCUMENTS

EP 0 154 558 9/1985
EP 0 759 400 2/1997
(Continued)

OTHER PUBLICATIONS

International Search Report issued May 11, 2011 in International (PCT) Application No. PCT/ES2010/070801.

*Primary Examiner* — Anthony Stashick
*Assistant Examiner* — Robert Poon
(74) *Attorney, Agent, or Firm* — Wenderoth, Lind & Ponack, L.L.P.

(57) ABSTRACT

The invention relates to a stackable container that includes a lower part, base or bottom (1), two long lateral walls or side panels (2) and two short lateral walls or front panels (3) that include a flat element that can consist of two end base planks (10), of two pairs of cornered base planks (10') or one complete base plank (10") shaped such that when a plurality of containers are stacked, the bottom of an upper container (1) rests on the flat element (10, 10', 10") of a lower container. The flat element (10, 10', 10") acts as a support surface for an upper container when it is stacked and as a reinforcement of the container structure, giving it strength and avoiding breakage during stacking.

19 Claims, 15 Drawing Sheets

(51) Int. Cl.
*B65D 6/24* (2006.01)
*B65D 6/00* (2006.01)

(56) References Cited

U.S. PATENT DOCUMENTS 4,867,327 A * 9/1989 Roland ..... A57C 3/029 217/12 R
7,959,063 B2 * 6/2011 McLeod ..... B65D 5/4608 229/143
2006/0237341 A1 * 10/2006 McDade ..... 206/509
2007/0075043 A1 * 4/2007 Riogonzalez ..... B65D 11/1873 217/13

FOREIGN PATENT DOCUMENTS

| | | |
|---|---|---|
| ES | 1 009 523 | 9/1989 |
| ES | 1 016 887 | 12/1991 |
| ES | 1 072 454 | 7/2010 |
| ES | 1 072 938 | 10/2010 |
| FR | 2 613 699 | 10/1988 |
| WO | 2006/075031 | 7/2006 |

* cited by examiner

STACKABLE CONTAINER

OBJECT OF THE INVENTION

The present invention, as expressed in the wording of this specification, relates to a stackable container of the type comprising a bottom, two long lateral walls or side panels and two short lateral walls or front panels.

The object of the invention is a container that can be stackable with improvements that help stabilizing and reinforcing the assembly of the container itself, and that also help to improve the stacking by distributing the weight of the containers when stacked in a more homogeneous way, while the fitting thereof is facilitated during stacking.

Another object of the invention is the characteristic details in the assembly structure between the bottom and the lateral walls.

Therefore, the invention provides a better container in terms of resistance to elevated weights and optimizes automatic manipulation.

BACKGROUND OF THE INVENTION

Several types of boxes and containers manufactured with corrugated cardboard, as well as with other more consistent materials are currently known, so that, in all cases, containers generally comprising a bottom, two long lateral walls or side panels and two short lateral walls or front panels, are formed.

The European invention patent under publication number 2322075 is also known, which relates to a mono-material container for horticultural use with a lid, which basically describes fixation means between the lateral walls and the bottom by means of a tongue and groove joint, also incorporating an upper part in the form of a lid arranged in correspondence with its mouthpiece.

Conventional containers or boxes, and more specifically, those corresponding to the aforementioned invention patent under publication number 2322075, have resistance and stability problems in the case of high weights in a stacking situation.

Therefore, in a column of stacked containers full of product, it is desirable that the weight is appropriately transmitted from the upper container all the way through the intermediate containers and down to the ground or support surface, so that its mechanical resistance is considerably greater and the breakage or fall of the column or stack is prevented, which would make its use unadvisable with high weights.

DESCRIPTION OF THE INVENTION

The stackable container that constitutes the object of the invention is determined based on independent laminar bodies made from cardboard or any other laminar material, said laminar structure comprising a bottom, two long lateral walls or side panels and two short lateral walls or front panels.

The stackable container of the present invention can also be made from wood, DM agglomerated plastic, etc.

The invention is characterized in that it incorporates projections starting from the free edges of the front and side panels, said projections being supplemented by notches established in the lower part of the side and front panels.

In addition, the front and side panels incorporate anchoring means in their adjacent lateral edges. These anchoring means are a combination of projections. The combination of the front panel projections comprises at least one upper front panel projection, one front panel projection and one lower front panel projection. The combination of side panel projections comprises at least one upper side panel projection, one side panel projection and one lower side panel projection. In addition, the container has at least one front panel notch and one side panel notch. The projections of the front and side panels are arranged alternatively on the adjacent lateral edges of the front and side panels, so that the front panel projections fit in the side panel notches and the side panel projections fit in the front panels notches.

The lower front panel projection delimits a front panel hole and the upper side panel projection delimits a side panel hole.

In addition, the lateral edges of the front panels incorporate angular ledges in which the straight ends of the side panel notch are positioned (R2).

The projections and the notches starting from the free edges of the front and side panels can present a trapezoidal configuration with rounded vertexes.

The side (2) panels and the front (3) panels are linked to the bottom (1) by means of projections that are adjusted in complementary slots. The bottom incorporates bottom side panel projections (35) in its edges, which match the side panels. Said projections are introduced in the lower side panel slots (36).

In turn, the front and side panels are linked to the bottom by means of projections that are adjusted in complementary slots.

In a first preferred embodiment of the invention, in order to improve the resistance conditions when the container is stacked, said container incorporates point support feet in its cornered areas in correspondence with its bottom, which are part of the lateral walls and are complemented by point support areas established in the cornered areas of the container in correspondence with its top opening. This way, when several containers full of products are stacked, the weight is transmitted point by point from the first container to the ones below until reaching the ground in correspondence with the cornered areas of the containers in a vertical linear direction, in which the aforementioned point feet and seats are located.

In an embodiment of the first preferred embodiment of the invention, the point feet are incorporated to the lower side panel projections, while the point seats are located in the upper front panel notches.

The function of the side panel notches can be, in addition to completing the side panel projections of an upper container when stacked, to delimit the lower part of the lower side panel projections and to also delimit the point feet incorporated to said lower side panel projections.

In another embodiment of the first preferred embodiment of the invention, the point feet are incorporated to the lower front panel projections (13'), while the point seats are located in the upper side panel projections (R6).

Other characteristics of the invention relate to the incorporation, in the cornered areas, of projections in the top opening of the box, which complement recesses established in correspondence with the bottom, recesses established on the lateral walls, so that, during stacking, the projections of a lower box are fitted and adjusted to the recesses of an upper box, said flaps and recesses favouring the convergence and alignment of the point feet and seats.

The projections that participate in the anchoring between the bottom and the lateral walls of the container may incorporate a barbed structure that considerably improves safety during the assembly of the container, preventing the accidental disassembly of said boxes.

In a second preferred embodiment of the invention, in order to improve the resistance conditions of the container when stacked, said container incorporates a base plank on the free upper edges of the front and side panels.

In a possible embodiment of the second preferred embodiment, the base plank incorporated by the container comprises two end base planks which ensure its positioning by means of characteristic projections that are part of the front and side panels and emerge towards the top of the same, said projections fitting in the complementary slots of the base planks. Another characteristic of the invention according to this possible embodiment of the second embodiment is that these projections are complemented with lower notches established in the lateral walls of the container themselves, so that when several containers are stacked, the projections of a lower container complimentarily fit the lower notches of an upper container, thus achieving a safe, reliable and precise stacking. This way, the projections generate retention stops to improve the stability of the stacking in terms of lateral movements, since they complement the notches provided for that purpose in the lateral walls themselves.

These end base planks are able to extend the support surface of the bottom of the upper containers, so that when several containers are stacked, the weight of said stacked containers is more uniformly distributed, while facilitating the fitting of the same at the same time. In addition, it should be noted that said projections present rounded vertexes that also contribute to the centring of the container.

All of the foregoing improves the container of the invention in terms of resistance to elevated weights, while also optimizing automatic manipulation.

The new structure of the container of the invention prevents deformations during the lateral compression of the containers when stacked. On the other hand, it should be noted that the side and front panel walls are connected to one another by means of characteristic anchoring means.

In another possible embodiment of the second preferred embodiment, the base planks are cornered base planks.

In another possible embodiment of the second preferred embodiment, the base planks comprise a complete base plank. Said complete base plank is provided with cornered slots where upper projections are adjusted, which are arranged in the end sections of the side panels by forming a part thereof, said connection of upper projections and cornered slots being complemented by other characteristic centred slots located in the vicinity of the short sides of the complete base plank, where characteristic centred projections starting from the free edge of the front panels are adjusted on the centred slots, forming an integral part thereof.

Another characteristic of this possible embodiment of the second preferred embodiment is that the centred projections of the front panels are provided with slots where projections of the complete base plank, which interrupt the continuity of the centred slots of said complete base plank, are fitted.

In order to complement said connection between the slots and the projections, the centred slots have end chamfers so that when the complete base plank is fitted in the top opening of the container, said end chamfers of the centred slots press and force the feet of the centred projections of the front panels to bend slightly inwards.

Therefore, the characteristic centred slots, thanks to the projections they include and also thanks to the end chamfers, present a characteristic specific geometry, so that, as indicated above, the end chamfers compress and softly curve the centred projections of the front panels, softly forcing them towards the interior of the container, thus improving the anchoring and the function of the projections themselves, which are adjusted on the slots of the centred projections of the front panels.

In a specific embodiment of this possible embodiment of the second preferred embodiment of the invention, the cornered slots of the complete base plank include notches for the introduction of the centring elements. These centring elements are used when there is a machine that places the complete base plank in its position in the container automatically. These notches essentially present a semicircular configuration.

The centred projections of the front panels are slightly trapezoidal in order to improve the introduction of the base plank and have an anchoring slotting for the corresponding projection and external steps to stabilize and retain the complete base plank to leave it coplanar to said steps. The complete base plank rests on the free upper edges of the later walls.

The complete base plank has grasping and aeration apertures, as well as longitudinal recesses to improve the sight of the product and aeration.

The complete base plank serves to improve the rigidity and the stacking when several containers are stacked.

In turn, the side panels and the front panels are linked to the bottom by means of projections that are adjusted in complementary slots.

Next, in order to facilitate a better comprehension of this specification and being an integral part thereof, figures representing the object of the invention in an illustrative rather than limitative manner, accompanies the specification.

REFERENCES

Figure 1:
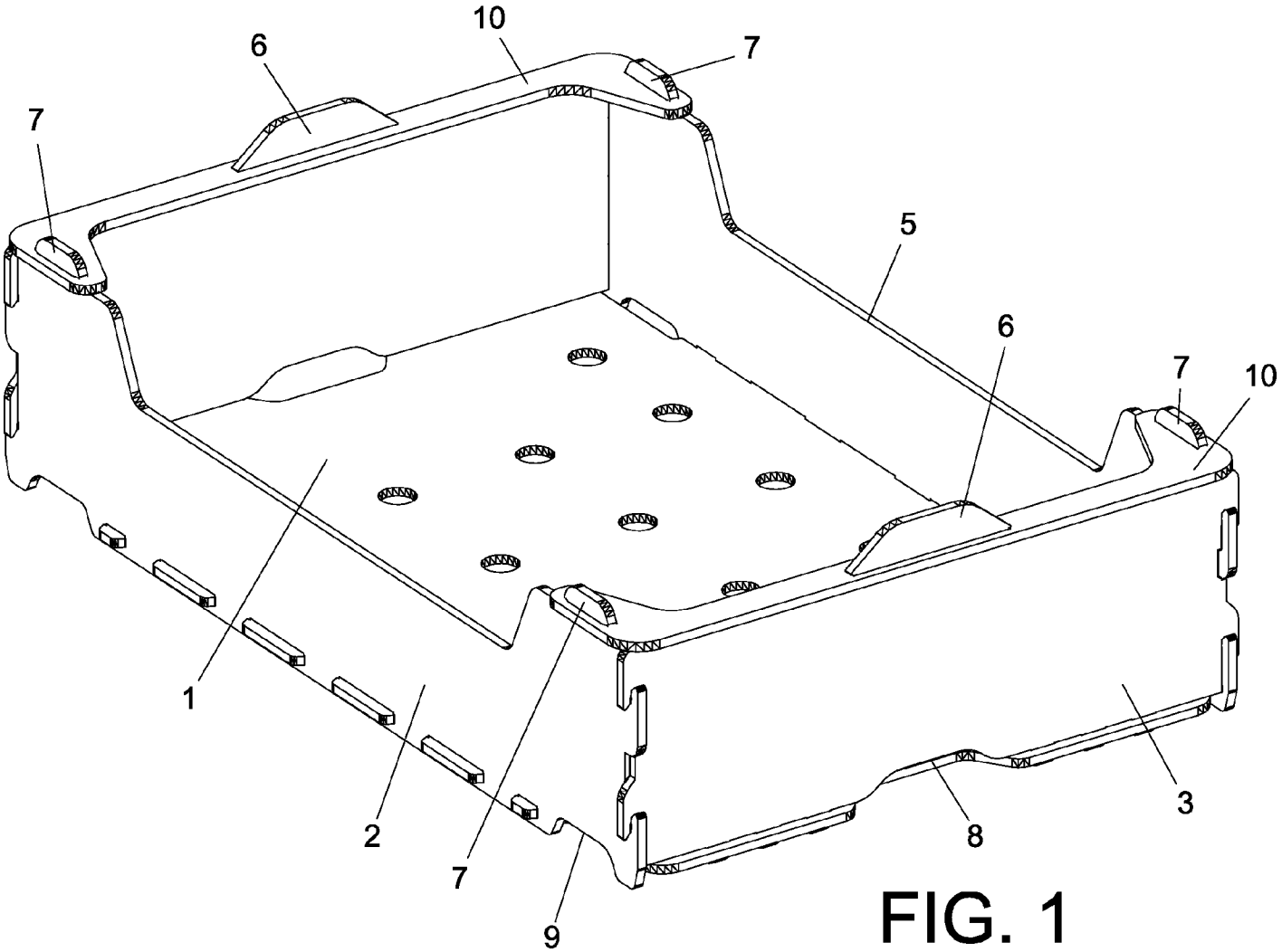
FIG. 1. Shows a perspective view of a stackable container with a flat element comprising two end base planks.

1. Bottom
2. Side panel
3. Front panel
4. Centred opening
5. Top opening
6. Centred projection
6'. Front panel projection
7. Side panel projection
8. Centred notch
8'. Front panel notch
9. Side panel notch
10. End base plank
10'. Cornered base plank
10". Complete base plank
11. Centred slot
11'. Front panel slot
12. Side panel slot
13. Front panel projection
13'. Lower front panel projection
13". Upper front panel projection
14. Side panel projection
14'. Upper side panel projection
14". Lower side panel projection
15. Front panel notch
16. Side panel notch
17. Second projection
18. Longitudinal recess
19. Front panel hole
20. Side panel hole
21. Angular ledge
22. Straight end
23. Point feet
24. Point seats
25. Projection with a barbed structure
26. Bottom slot
27. First projection
28. Slot of the centred projection
29. End chamfer
30. End step
31. Recess
32. Grasping aperture
33. Ventilation aperture
34. Cornered cuts
35. Bottom projection on the side panel
36. Lower side panel slots
37. Notches in the upper edge of the front panels

DESCRIPTION OF THE PREFERRED EMBODIMENT

Taking into account the numeration adopted in the figures, the stackable container comprises a bottom (1), two long lateral walls or side panels (2) and two short lateral walls or front panels (3), the front panels (3) having centred apertures (4) like handles to manipulate the container comfortably. Each one of these elements (lateral walls and bottom) is independent pieces connected to each other by their adjacent edges.

In turn, the side panels (2) incorporate wide trapezoidal mouthpieces (5) in their free edges.

The stackable container of the present invention is characterized in that it incorporates flat elements (10, 10', 10") that rest on at least the end portions of the free edges of the front (3) and side (2) panels, said flat elements (10, 10', 10") incorporating slots (11, 11', 12) where the lower portions of projections (6, 6', 7) starting from said free edges of the front (3) and side (2) panels are fitted. The bottom (1) of an upper container rests on the flat elements (10, 10', 10") of another lower container when several containers are stacked.

The incorporation of these flat elements (10, 10', 10") is the essential characteristic of the present invention, since no other container with flat elements of this type is known in the state of the art, which, aside from serving as support when stacking more than one container, serve to give strength to the container itself and to prevent said container from breaking or deforming when other containers carrying much weight are stacked on top.

Figure 13:
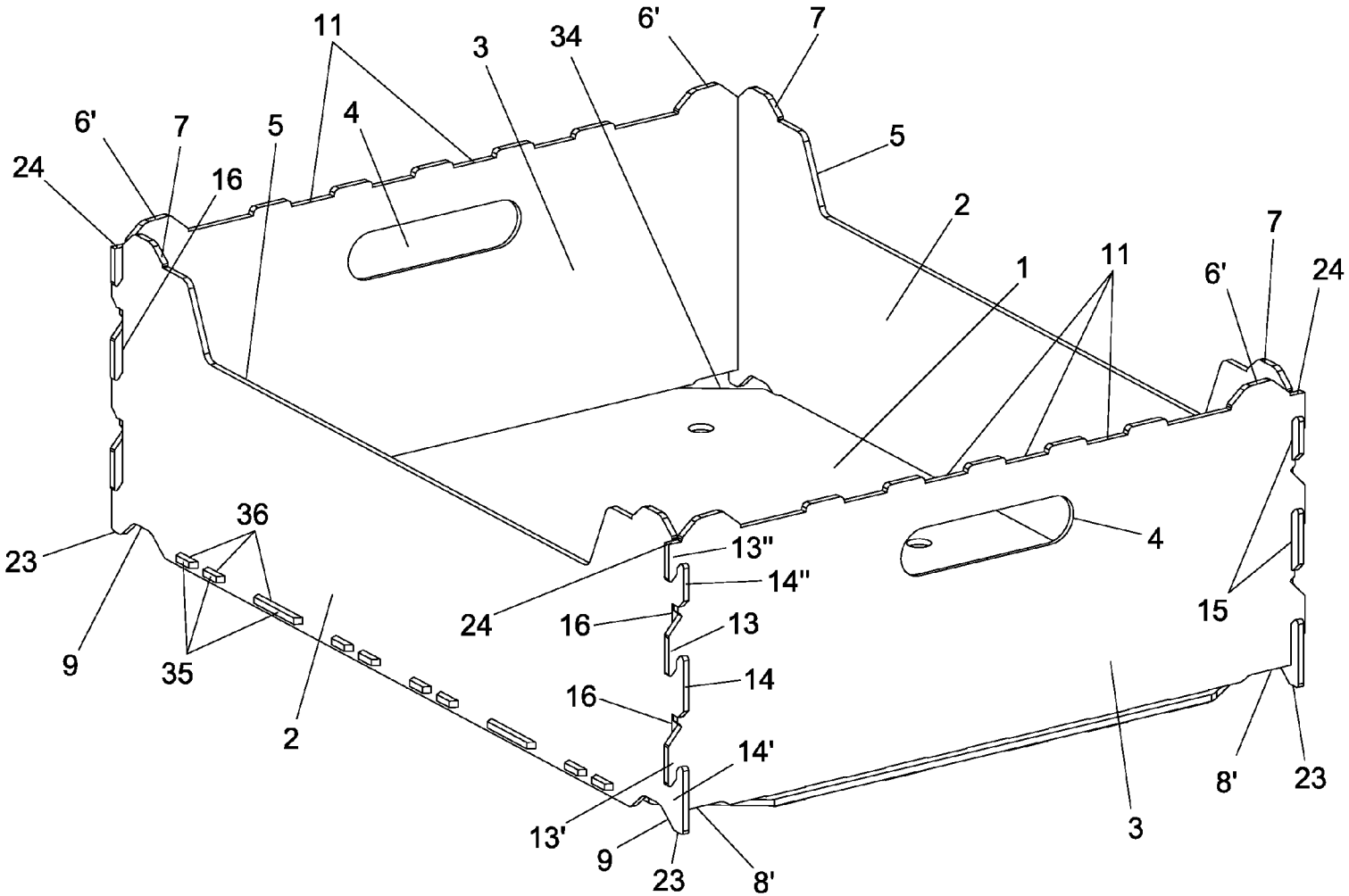
FIG. 13. Shows a perspective view of the stackable container object of the invention.
Figure 14:
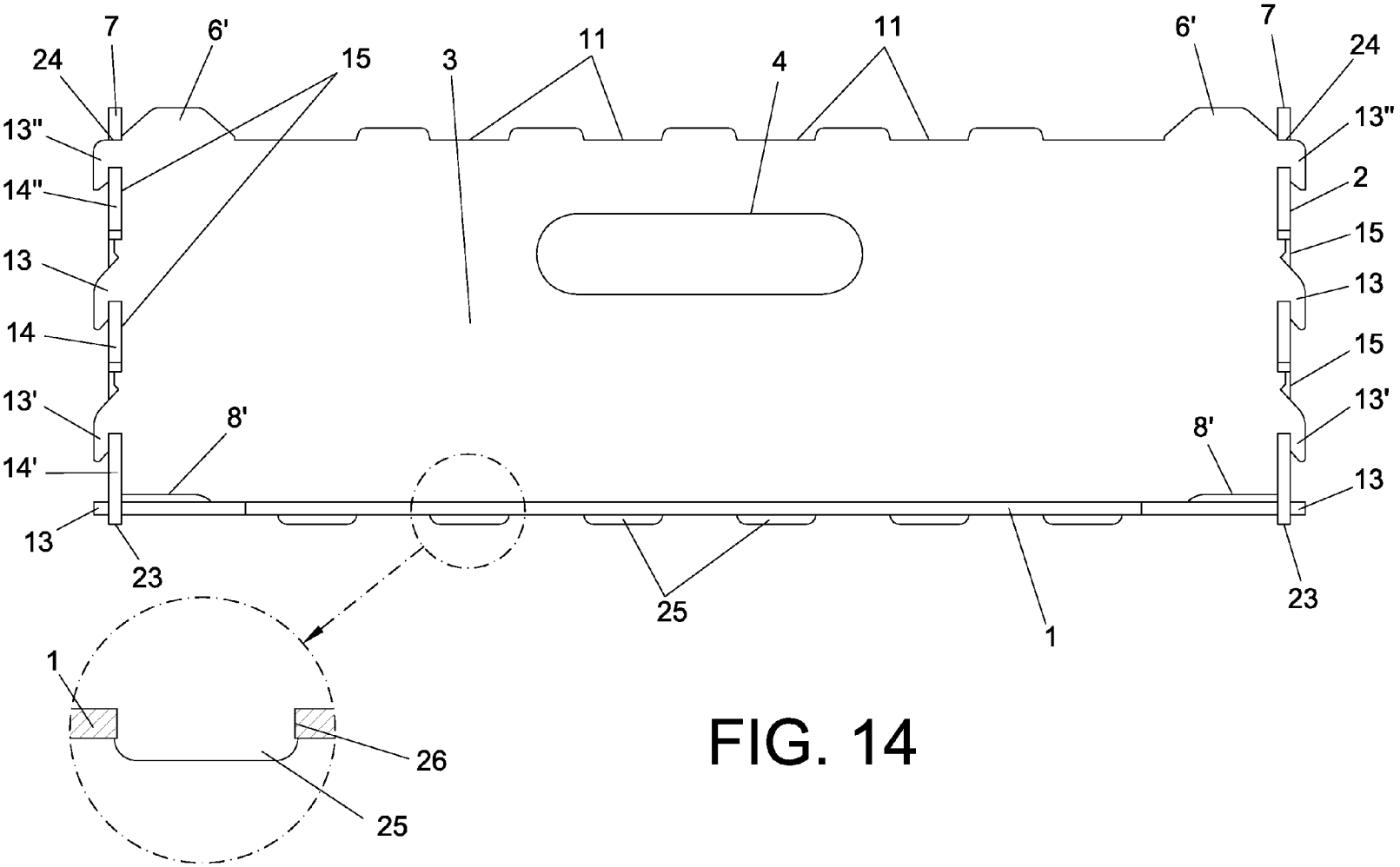
FIG. 14. Shows a frontal view of the container of the invention.
Figure 15:
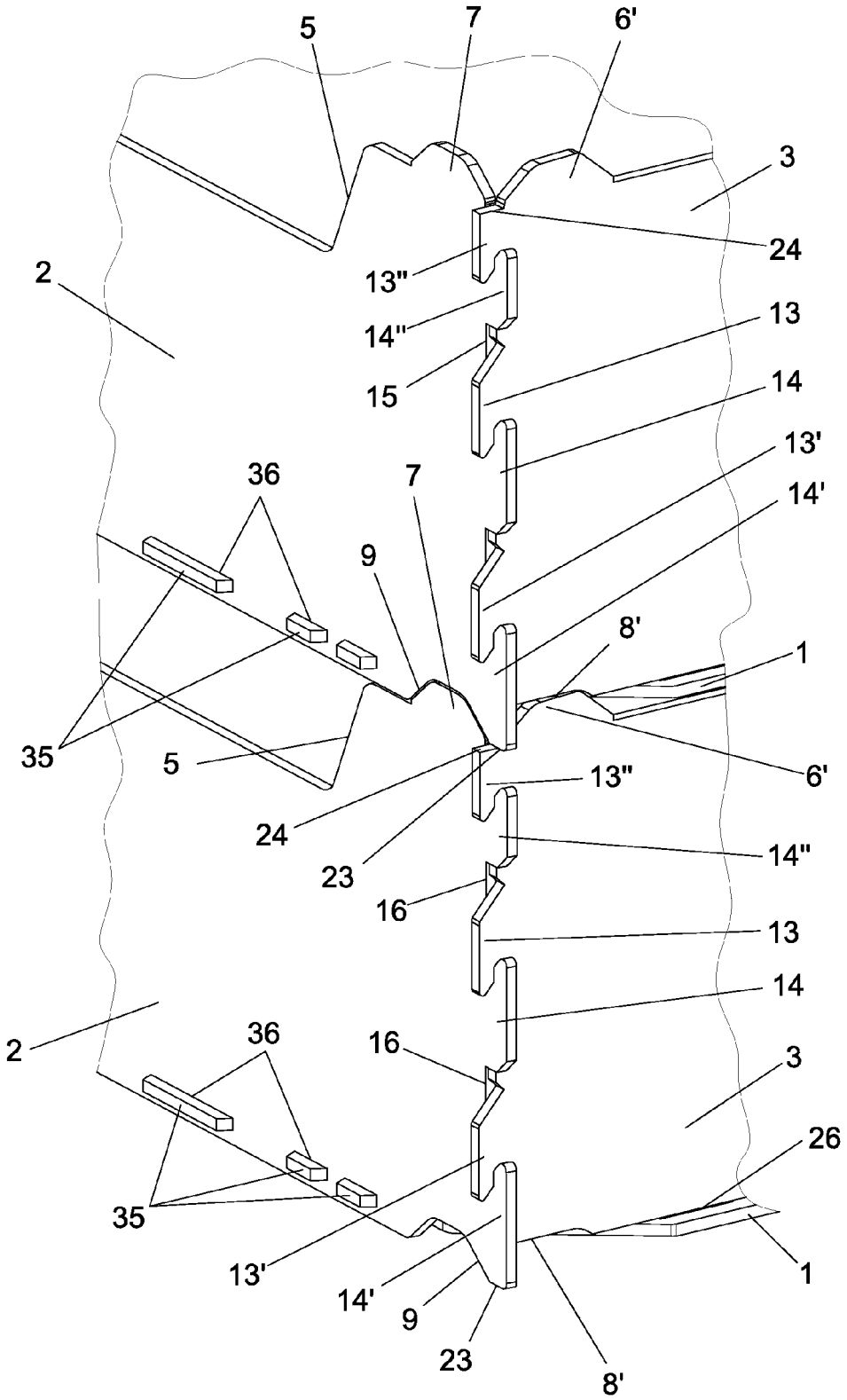
FIG. 15. Shows a perspective view of the stacking of two containers of the invention.

These flat elements can comprise two end base planks (10), as shown in FIG. 15, two pairs of cornered base planks (10'), as shown in FIG. 14, or may comprise a complete base plank (10"), as the one shown in FIG. 13.

The container incorporates projections (6, 6', 7), which start from the free edges of the front (3) and side (2) panels, being said projections complemented by notches (8, 8', 9) established in the lower part of the side (2) and front (3) panels. In addition, the side (2) and front (3) panels incorporate anchoring means in their adjacent lateral edges, which comprise a combination of projections comprising at least one front panel projection (13) and one side panel projection (14) and one front panel notch (15) and one side panel notch (16). The projections are arranged alternatively on the adjacent lateral edges of the side (2) and front (3) panels, so that the front panel projections (13) are fitted in the side panel notches (16) and the side panel projections (14) are fitted in the front panel notches (15), the front panel projections (13) incorporating a lower front panel projection (13') delimiting a front panel hole (19) and the side panel projections (14) incorporating an upper side panel projection (14") delimiting a side panel hole (20). As shown in the figures, the front and side panel projections (13, 14) are preferably hook-shaped.

The lateral edges of the front panels (3) can incorporate angular ledges (21) in which straight ends (22) of the side panel notch (16) are positioned.

The projections (6, 6', 7) and the notches (8, 8', 9) can present a trapezoidal configuration of rounded vertexes.

Figure 2:
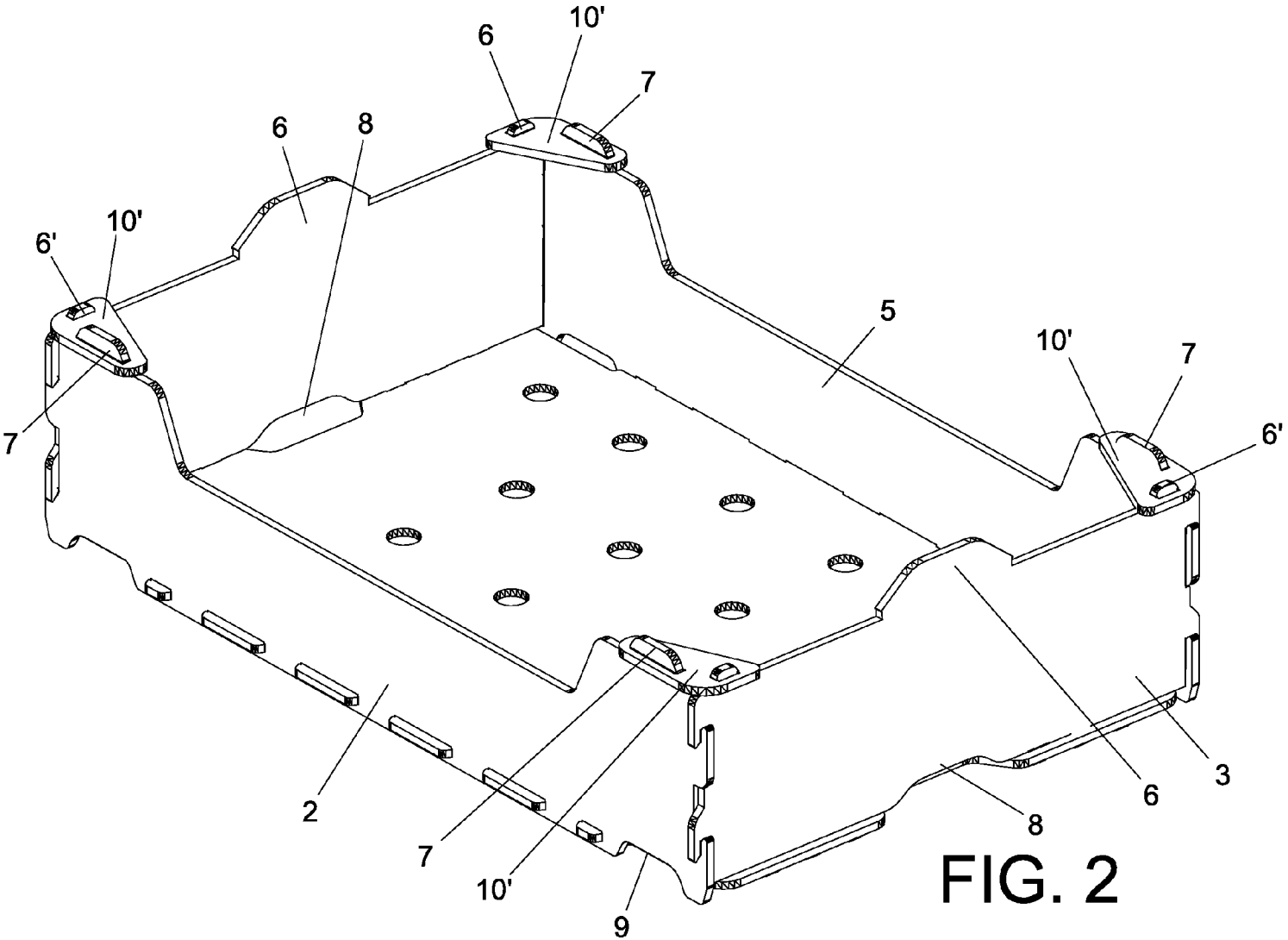
FIG. 2. Shows a perspective view of a stackable container with a flat element comprising two pairs of cornered base planks FIG. 3. Shows a perspective view of a stackable container with a flat element comprising a complete base plank.
Figure 3:
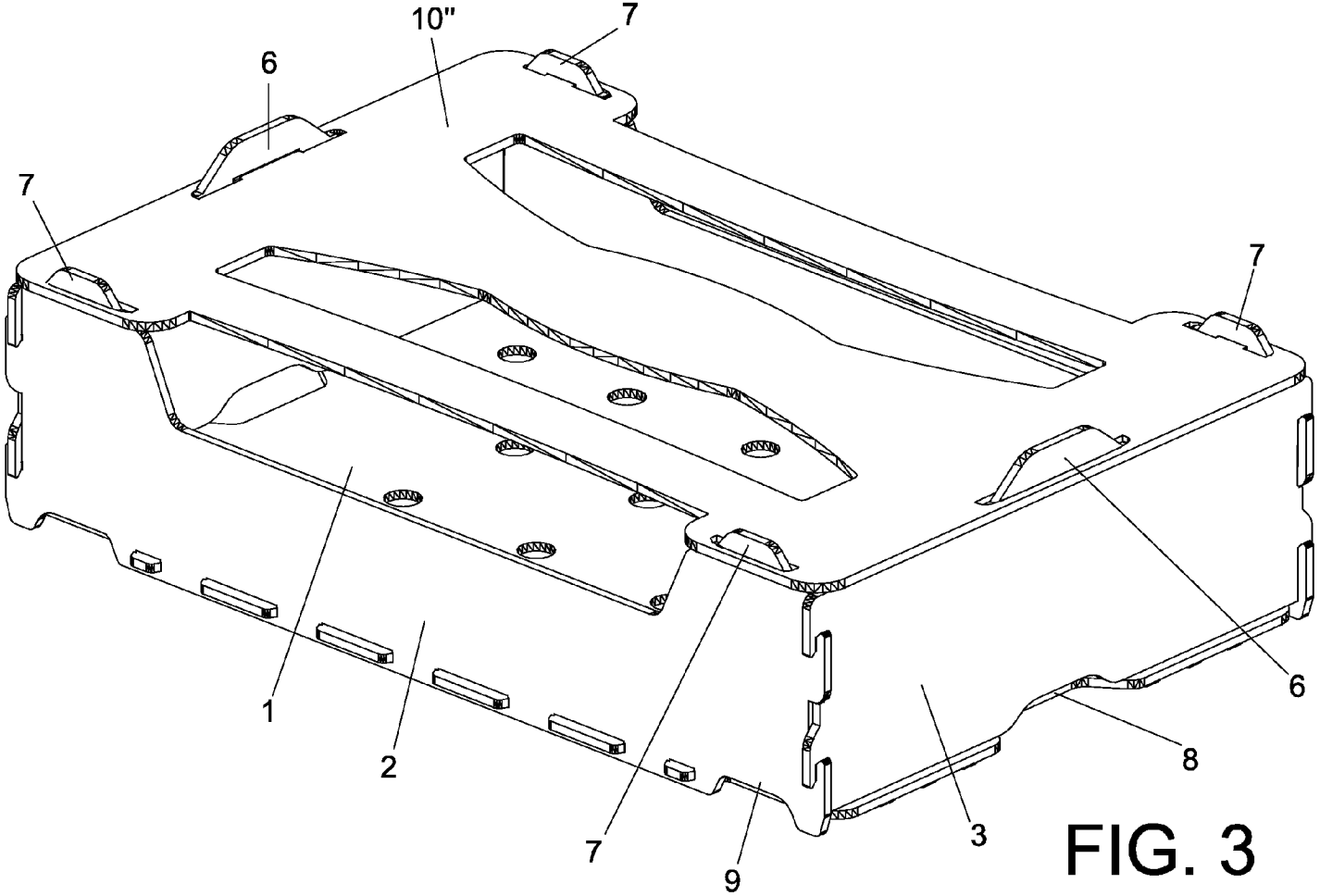

In a first embodiment of the invention, shown in FIGS. 1, 2 and 3, the lower part of the container corresponding to its bottom incorporates point feet (23) arranged in the same vertical direction than point seats (24) arranged in the upper part of the container in correspondence with its top opening, being said point seats (24) and point feet (23) in the same vertical corners of the containers where the side (2) and front (3) panels converge.

When several containers are stacked, the point feet (23) of an upper container rest on the point seats (24) of a lower container. This way, the load is transmitted to the ground precisely in the vertical directions of these point seats (24) and point feet (23).

In a possible embodiment of this first preferred embodiment, the point feet (23) are incorporated to the lower side panel projections (14'), while the point seats (24) are located on the upper front panel projections (13").

In this first preferred embodiment, the lower edges of the front panels (3) incorporate projections with a barbed structure (25), which are adjusted in the bottom slots (26) complementary to the projections with the barbed structure (25).

In a second preferred embodiment of the invention, the container comprises at least one flat element.

Figure 4:
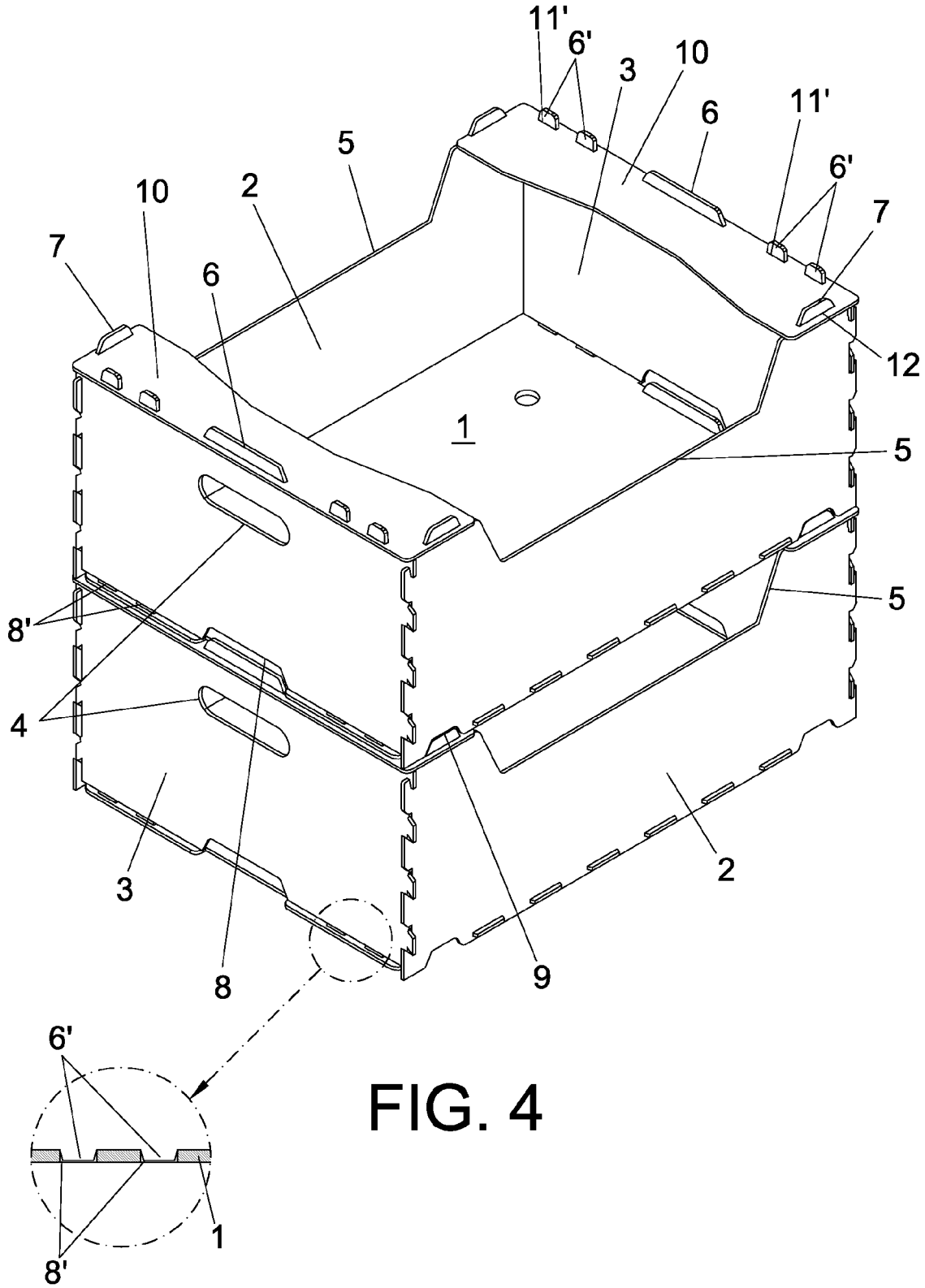
FIG. 4. Shows a perspective view of the stacking of two stackable containers, each one of which constitutes the object of the invention.

In an embodiment of this second preferred embodiment, shown in FIG. 4, the flat element comprises two end base planks (10), which incorporate at least one centred slot (11), one front panel slot (11') and one side panel slot (12). The lower portions of at least one centred projection (6), one front panel projection (6') and one side panel projection (7) are fitted in said slots, which start from the free edges of the front panels (3) and side panels (2), respectively. In this embodiment, the container also contains at least one centred notch (8), one front panel notch (8') and one side panel notch (9), established in the lower part of the side (2) and front (3) panels.

The centred projections (6) are located in the upper free edges of the centre of the front panels (3). The front panel projections (6') are located at the end of the upper free edges of the front panels (3). The side panel projections (7) are located at the end of the upper free edges of the side panels (2).

The centred slots (8) are located on the lower free edge of the front panels (3) in the position complementary to the centred projections (6). The front panel slots (8') are located in the lower free edge of the front panels (3) in the position complementary to the front panel projections (6'). The side panel slots (9) are located on the lower free edge of the side panels (2) in the position complementary to the side panel projections (7).

In this embodiment of the second preferred embodiment, when several containers are stacked, an upper container rests through its bottom (1) on the two end base planks (10), while the centred projection (6) and the side panel projection (7) of the upper container fit the centred notch (8), and the side panel notch (9) of the respective upper container. In addition, there are notches in the upper edge of the front panels (37), which are complementary to the projections with a barbed structure (25) located on the front panels (3).

This way, total stability and safety in the stacking of the containers are achieved, as well as great rigidity and strength in the assembly of the container.

Figure 5:
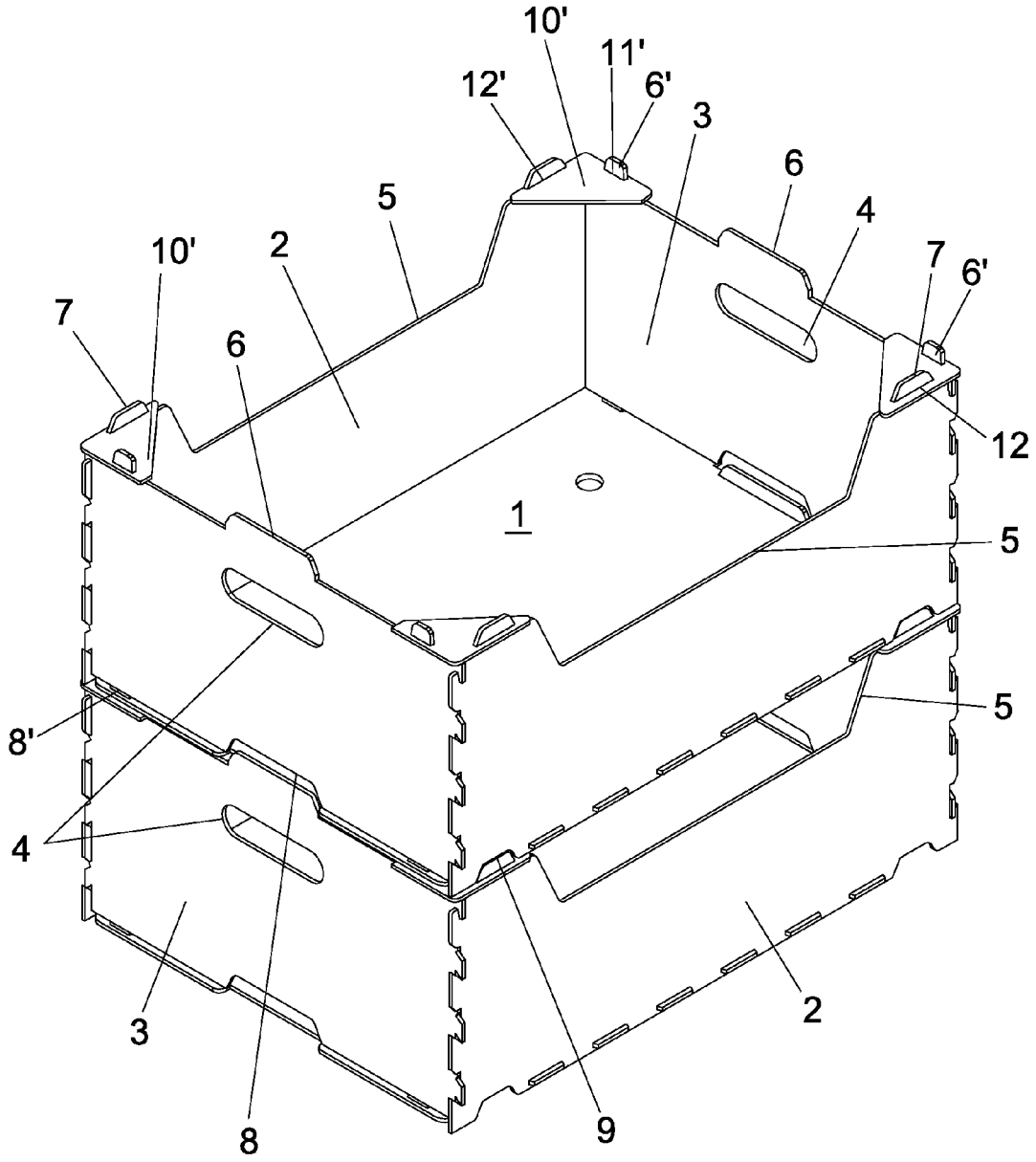
FIG. 5. Shows another embodiment of the container of the invention.
Figure 6:
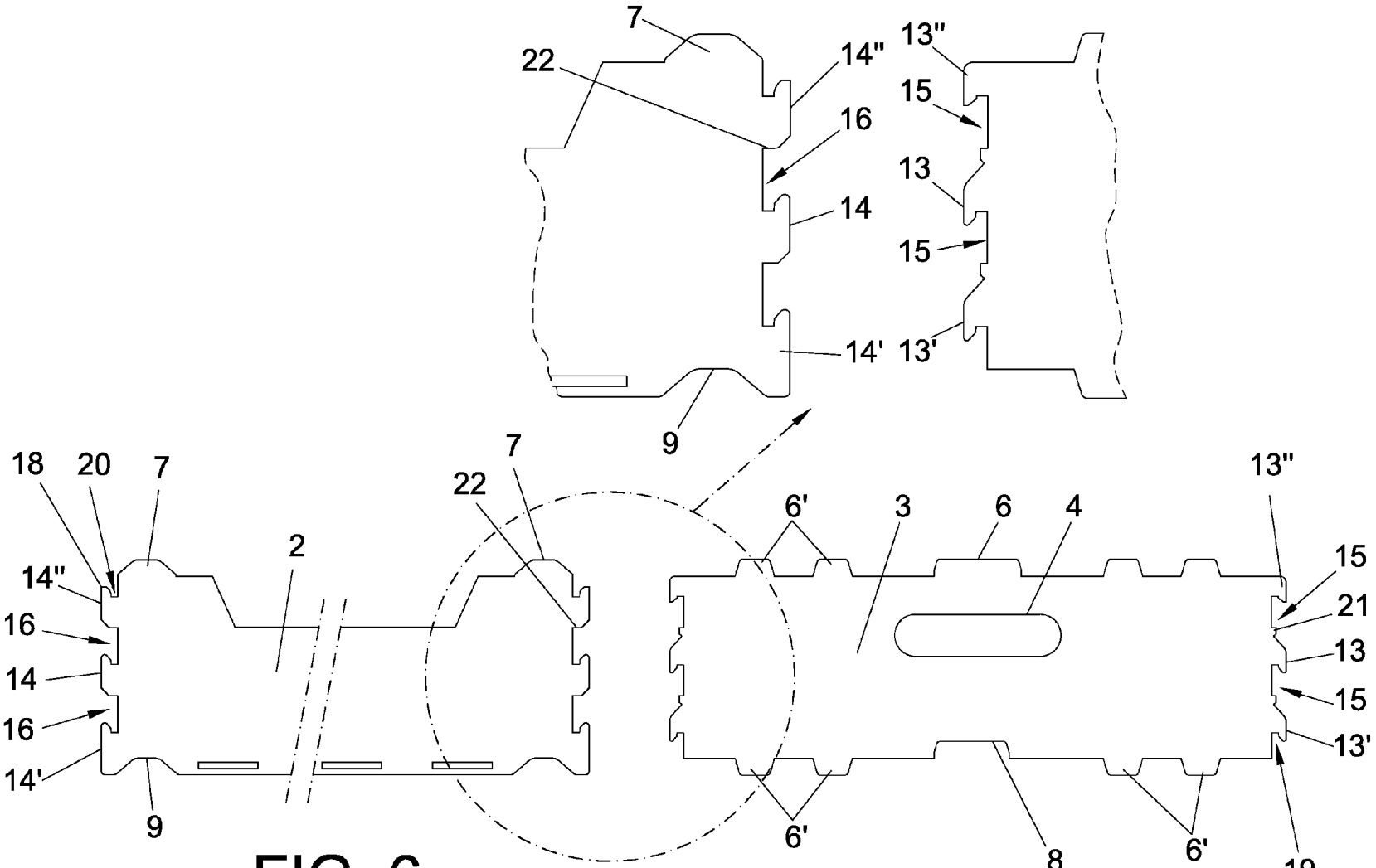
FIG. 6. Shows a view showing the anchoring means between the side panels and the front panels constituting the lateral walls of the container.

In another possible embodiment of this second preferred embodiment, shown in FIG. 5, the flat element comprises two pairs of cornered base planks (10') that rest on the end portions of the free edges of the front panels (3) and also on the end portions of the free edges of the side panels (2). In this case, said cornered base planks (10') comprise a front panel slot (11') and a side panel slot (12) to allow the passage and fitting of the front panel projections (6') and the side panel projections (7).

In addition, the container also comprises at least one front panel notch (8') and one side panel notch (9), established in the lower part of the side (2) and front (3) panels.

Figure 7:
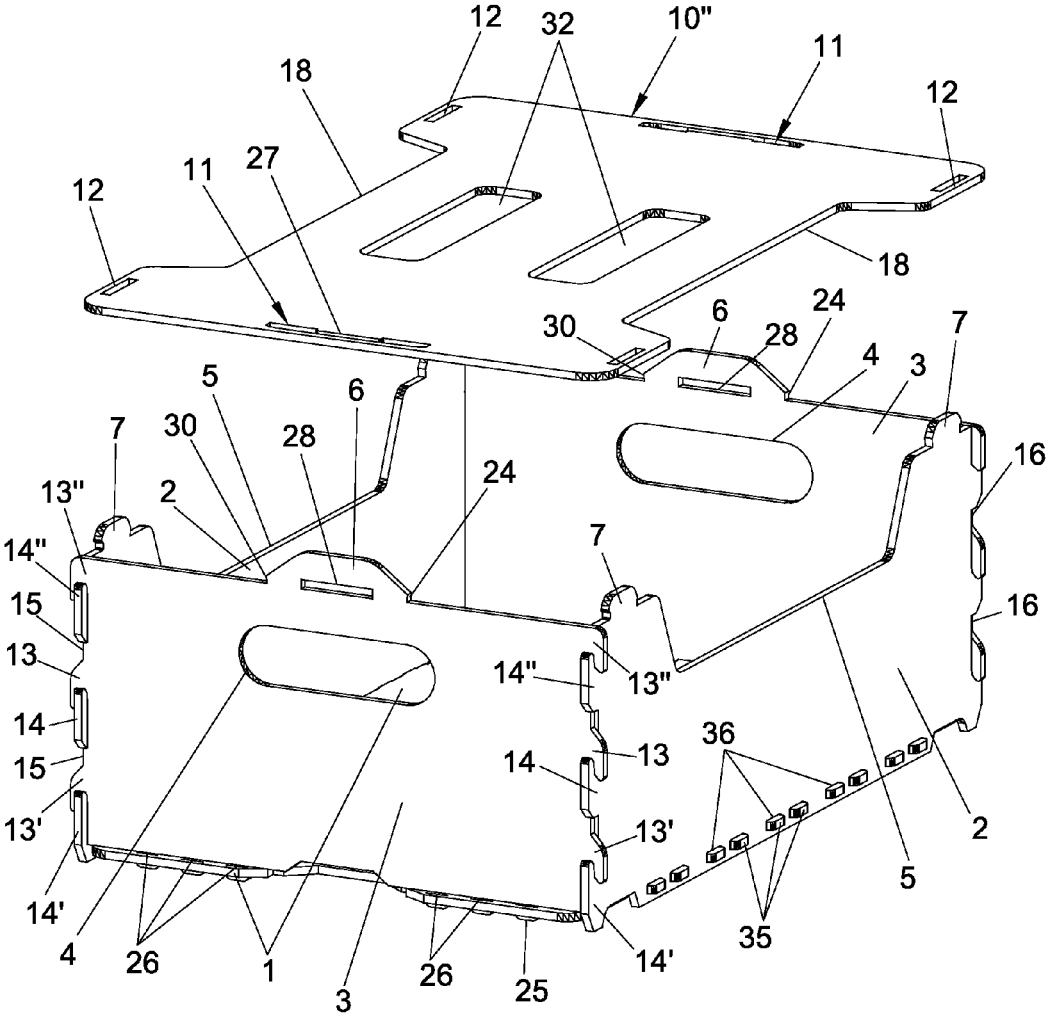
FIG. 7. Shows a perspective view of the stackable container object of the invention. It basically comprises a bottom, two long lateral walls or side panels and two short lateral walls or front panels, the complete base plank being coupled in correspondence with the top opening of the container.
Figure 8:
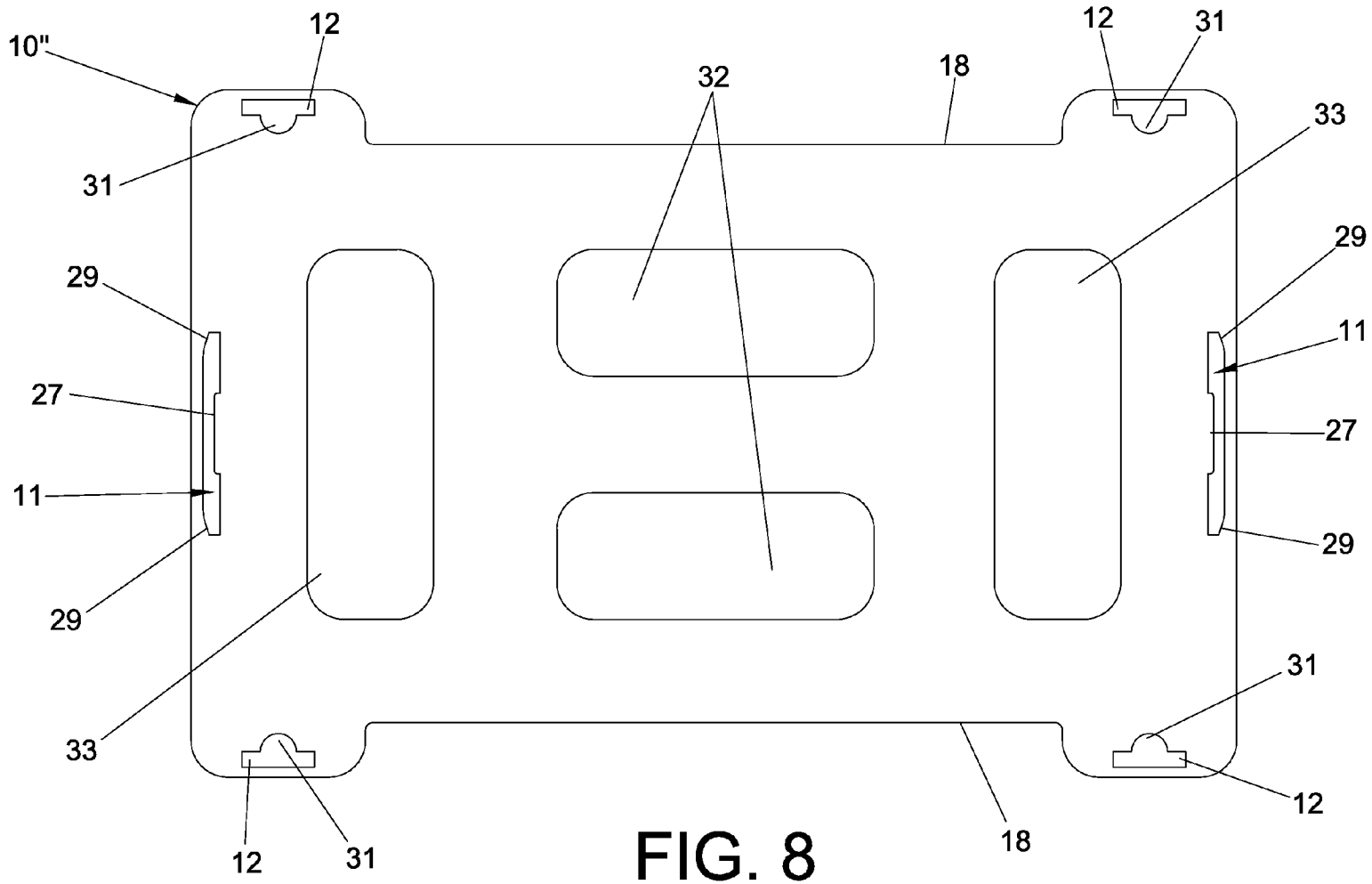
FIG. 8. Shows a plant view of the complete base plank.
Figure 9:
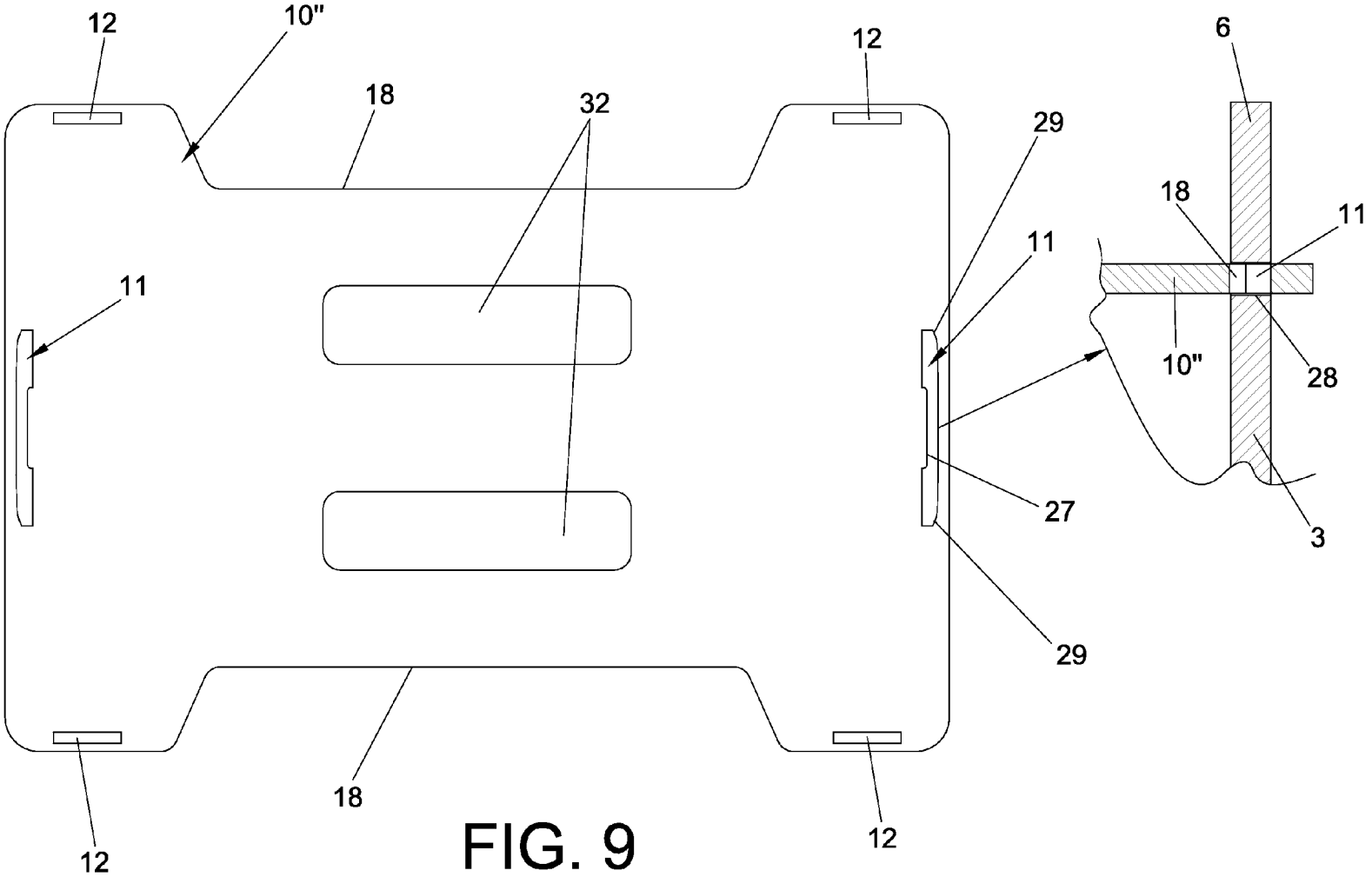
FIG. 9. Shows a plant view of the complete base plank with another embodiment, different than the one shown in the previous figure.
Figure 10:
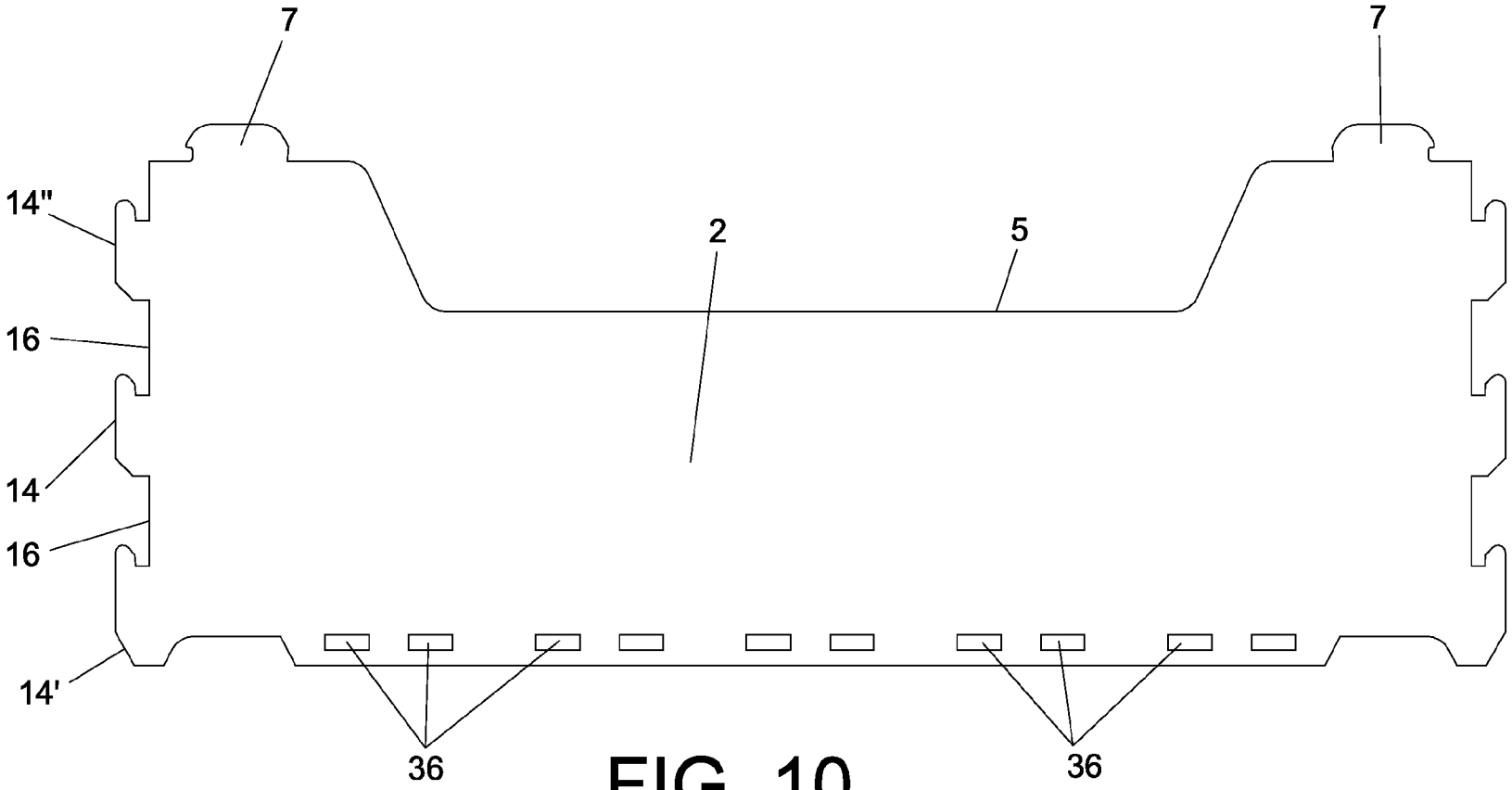
FIG. 10. Shows a lateral view of the stackable container showing a side panel frontally.
Figure 11:
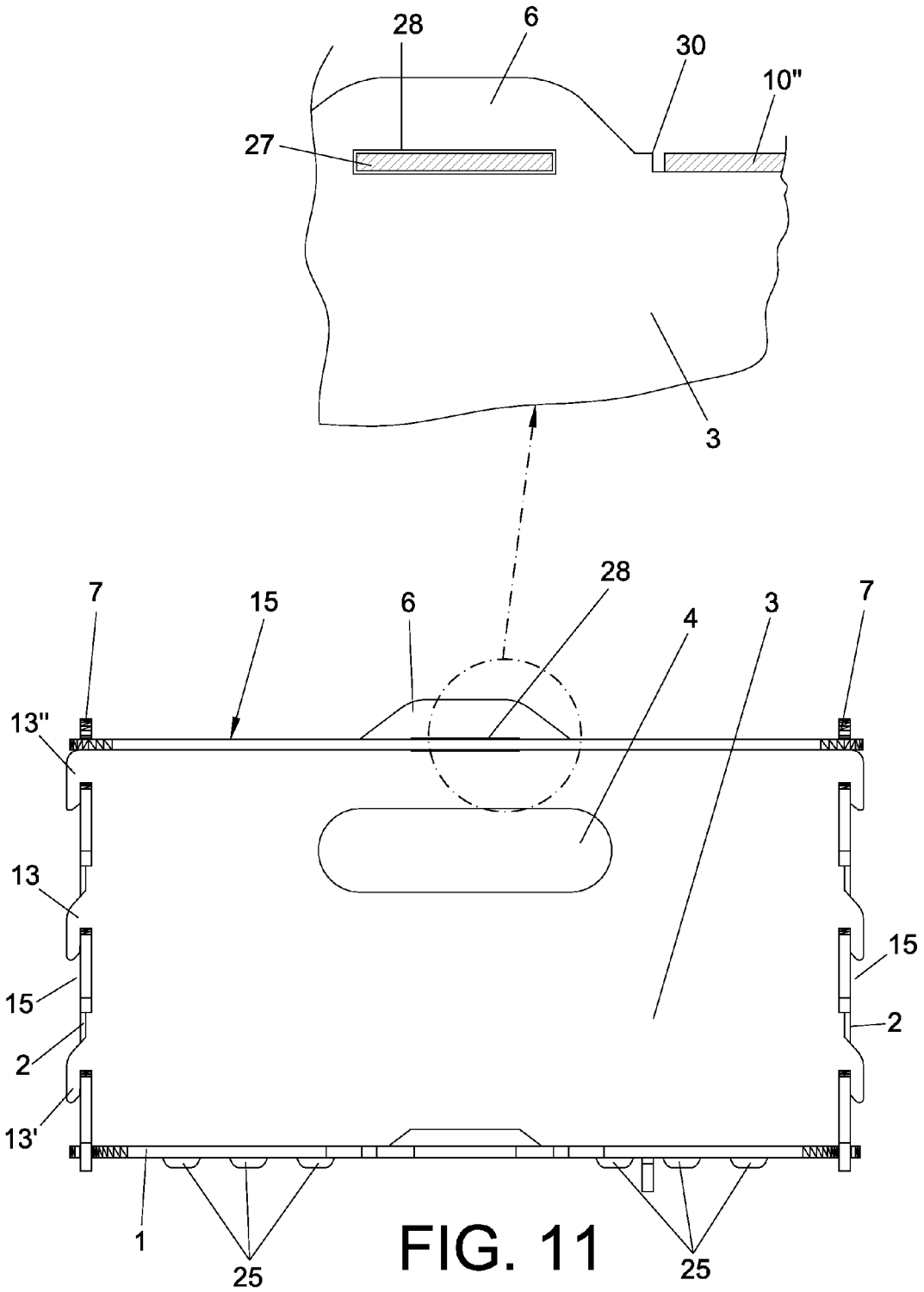
FIG. 11. Shows a lateral view of the stackable container showing a front panel frontally.
Figure 12:
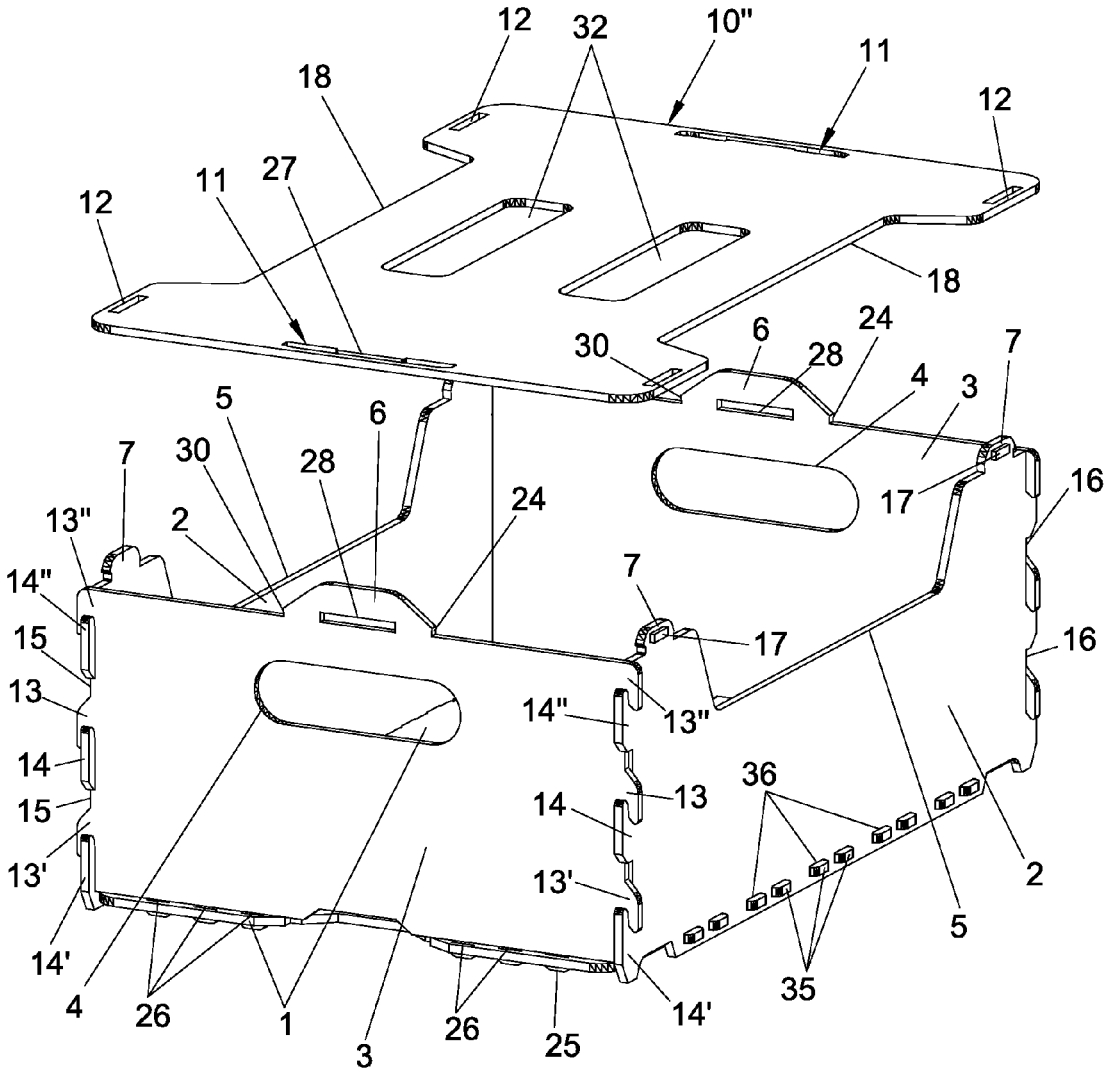
FIG. 12. Shows a perspective view of the container with a complete base plank in an embodiment incorporating projections so that the complete base plank remains secured in its position.

On the other hand, the side (2) and the front (3) panels are connected to each other by means of characteristic anchoring means, as shown more clearly in FIG. 7.

In turn, the lateral edges of the front panels (3) incorporate angular ledges (21) where the straight tips (22) of the side panel notches (16) are positioned.

When several containers are stacked, the bottom (1) of the upper container rests on the base plank (10') of the lower container and the projections (6, 6', 7) of said lower container fit in the notches (8, 8', 9) of the upper container.

In another preferred embodiment of this second preferred embodiment, shown in FIG. 7, the flat element comprises a complete base plank. According to this possible embodiment of the invention, the container incorporates at least one centred slot (11) and one side panel slot (12) to allow the passage and fitting of at least one centred projection (6) and one side panel projection (6'), and the container comprises at least one front panel notch (8') and one side panel notch (9) established in the lower part of the side panels (2) and front panels (3).

When several containers of this type are stacked, the projections of a lower container fit in the notches of a higher container.

In this embodiment example, the contour of the centred slot (11) of the complete base plank (10") has at least one first projection (27), which is fitted in at least one slot of the centred projection (28), said centred slot (11) including end chamfers (29) intended to bend the centred projections (6) inward by their extremities and also intended to bend the front panels (3) inward.

The centred projections (6) can present a trapezoidal configuration and have end steps (30), which are levelled with the complete base plank (10").

The side panel slots (14) can have recesses (31). In a possible embodiment, said recesses are circular in shape.

In addition, the complete base plank (10") may have grasping (32) and aeration (33) apertures, as well as longitudinal recesses (18) in correspondence with the long edges of the complete base plank in order to improve the sight and aeration of the product.

In a possible embodiment of the invention, the side panel projections (7) incorporate a second rib (17), which is fitted in the side panel slot (12) of the complete base plank (10").

The invention claimed is:

1. A stackable container comprising independent laminar elements, said independent laminar elements being a bottom panel, two side panels and two front panels, the side panels, the front panels and the bottom panel being attached to each other by anchoring parts and the stackable container having a configuration to ensure stability during stacking, wherein the anchoring parts for attaching the front panels to the side panels comprise:

a set of first hook-shaped anchoring parts and a set of first notches incorporated alternatively at lateral edges of each of the front panels, wherein a lower end of each first hook-shaped anchoring part is hook-shaped; and a set of second hook-shaped anchoring parts and a set of second notches incorporated alternatively at lateral edges of each of the side panels, wherein an upper end of each second hook-shaped anchoring part is hook-shaped;

so that the set of first anchoring parts links with the set of second anchoring parts in such a way that the set of first anchoring parts fits in the set of second notches and the set of second anchoring parts fits in the set of first notches;

the stackable container further comprising:

a set of first projections starting from top edges of the front panels and a set of second projections starting from top edges of the side panels;

an independent upper flat element that rests on the top edges of the front and side panels, said independent upper flat element incorporating slots in correspondence with locations of the first and second projections on which the slots are fitted;

stacking notches established in lower edges of the side and front panels in locations corresponding with locations of the first and second projections, so that, when said stackable container constitutes an upper stackable container stacked with a lower stackable container that is identical to the upper stackable container, first and second projections of the lower stackable container are fitted in the stacking notches of the upper stackable container in such a way that the first and second projections of the lower stackable container abut against the bottom panel of the upper stackable container when a lateral force is exerted so as to avoid lateral displacements of the upper stackable container with respect to the lower stackable container, and the lower edges of the front and side panels of the upper stackable container rest on an upper flat element of the lower stackable container; and point feet located in lower corners of the side panels and point seats located in upper corners of the side panels, the point feet and the point seats being arranged in a same vertical direction, wherein each point foot is delimited by one of the stacking notches and a lower one of the set of second notches, such that the point feet of an upper stackable container are configured to transmit point by point a weight of the upper stackable container to the lower stackable container through the independent upper flat element and point seats of the lower stackable container.

2. A stackable container, according to claim 1, wherein the lateral edges of each of the front panels further incorporate angular ledges in which straight ends of the second hook-shaped anchoring parts of the side panels are positioned.

3. A stackable container, according to claim 1, wherein each of the first and second projections and each of the stacking notches has a trapezoidal configuration with rounded vertexes.

4. A stackable container, according to claim 1, wherein the independent upper flat element is one of a plurality of independent upper flat elements which each include two end base planks, which each incorporate at least one centred slot and one side panel slot, the lower portions of at least one centred projection and one side panel projection being fitted in said at least one centred slot and one side panel slot, the projections starting from the free edges of the front and side panels, respectively, and the stackable container comprising at least one centred notch and one side panel notch, established in a lower part of the side and front panels.

5. A stackable container, according to claim 1, wherein the independent upper flat element is one of a plurality of independent upper flat elements which each include two pairs of cornered base planks incorporating at least one front panel slot and one side panel slot to allow the passage and fitting of at least one front panel projection and one side panel projection, and the stackable container comprising at least one front panel notch and one side panel notch, established in a lower part of the side panels and front panels.

6. A stackable container, according to claim 1, wherein the independent upper flat element is composed by a complete base plank, the first projections include at least one centred projection in each of the front panels, and the second projections include one side panel projection at each end of each of the side panels, the slots of the independent upper flat element include at least one centred slot and one side panel slot to allow the passage and fitting of the at least one centred projection and the one side panel projection, and the stacking notches include at least one front panel notch and one side panel notch established in the lower edges of the front and side panels, respectively.

7. A stackable container, according to claim 6, wherein a contour of the at least one centred slot of the complete base plank has at least one first projection, which is fitted in at least one slot of the centred projection, said centred slot including end chamfers intended to bend the centred projections inward by extremities thereof and also intended to bend the front panels inward.

8. A stackable container, according to claim 6, wherein each of the centred projections presents a trapezoidal configuration and has end steps, which are levelled with the complete base plank.

9. A stackable container, according to claim 6, wherein the side panel slots are formed with notches.

10. A stackable container according to claim 9, wherein the notches of the side panel slots are circular.

11. A stackable container, according to claim 6, wherein the complete base plank incorporates at least two grasping apertures.

12. A stackable container, according to claim 6, wherein the complete base plank incorporates at least two ventilation apertures.

13. A stackable container, according to claim 6, wherein the complete base plank incorporates longitudinal recesses established in correspondence with long edges of the complete base plank.

14. A stackable container, according to claim 6, wherein the side panel projections incorporate a second projection, which is fitted in the side panel slot of the complete base plank.

15. A stackable container according to claim 1, wherein the lower edges of the front panels incorporate projections with a barbed structure, wherein said projections with the barbed structure fit in complementary slots of the bottom panel.

16. A stackable container, according to claim 1, wherein the stackable container is made of wood, cardboard or DM agglomerated plastic.

17. A stackable container, according to claim 1, wherein a height of the projections is greater than a distance of the bottom panel to the lower edge of the front and side panels.

18. A stackable container, according to claim 1, wherein the set of first projections comprises one centred projection on each front panel having a bigger size than the second projections to facilitate alignment of the upper stackable container relative to the lower stackable container, when stacked.

19. A stackable container, according to claim 1, wherein the independent upper flat element is an independent laminar element.

* * * * *